United States Patent [19]

Bick

[11] Patent Number: 4,571,752

[45] Date of Patent: Feb. 25, 1986

[54] SANITARY DEVICE SYSTEM

[76] Inventor: Hal W. Bick, P.O. Box 20386, Billings, Mont. 59104

[21] Appl. No.: 642,880

[22] Filed: Aug. 21, 1984

[51] Int. Cl.[4] ..... E03D 9/02

[52] U.S. Cl. ..... 4/300; 4/DIG. 5

[58] Field of Search ..... 4/300, 228, 223, 225, 4/231, 309, 232, DIG. 5; 261/30

[56] References Cited

U.S. PATENT DOCUMENTS

| | | | |
|---|---|---|---|
| 1,495,644 | 5/1924 | Poussin | 4/223 |
| 2,688,141 | 9/1954 | Filliung | 4/303 |
| 3,383,710 | 5/1968 | Sumner | 4/300 |
| 3,428,970 | 2/1969 | Barcita | 4/223 |
| 3,874,007 | 1/1975 | Dolan | 4/228 |
| 3,890,657 | 6/1975 | Gray | 4/228 |
| 3,946,448 | 3/1976 | Sioufy | 4/231 |
| 3,999,226 | 12/1976 | Wolf | 4/225 |
| 4,312,082 | 1/1982 | Murphy et al. | 4/228 |
| 4,321,714 | 3/1982 | Takai et al. | 4/300 |
| 4,494,452 | 1/1985 | Barzso | 261/30 |

*Primary Examiner*—Stephen Marcus
*Assistant Examiner*—Leo J. Peters
*Attorney, Agent, or Firm*—Arthur L. Urban

[57] ABSTRACT

A sanitary device liquid circulation system includes a water supply portion, an additive supply portion and an air supply portion. The water supply portion includes a water source, a selectively renewable water pool, a delivery passage extending from the water source to the water pool and a valve controlling the flow of water from the water source to the water pool. The additive supply portion includes an additive reservoir, a first conduit extending from the reservoir to the delivery passage and metering mechanism disposed along the first conduit. The metering mechanism includes a chamber, a movable piston disposed within the chamber with the piston being movable in response to water flow changes in the water supply portion. The air supply portion includes an electrical motor, an electrical power source for the motor and control mechanism intermittently actuating the motor. Pulsing mechanism is operatively connected to the motor and a pump includes a movable diaphragm responsive to the pulsing mechanism. There is an outlet from the pump and a second conduit extends from the outlet in the water pool. The second conduit includes an outlet in the water pool providing a multiplicity of small spaced openings. A predetermined quantity of additive is metered into the pool of water in response to water flow changes in the water supply portion and air is introduced intermittently into the water pool in a multiplicity of bubbles to maintain a foam in the water pool.

16 Claims, 6 Drawing Figures

SANITARY DEVICE SYSTEM

This invention relates to a novel liquid circulation system and more particularly relates to a new liquid circulation system for sanitary devices.

In primitive societies, the disposal of human waste was relatively simple. Since only a single individual or a few people lived together and there were large unoccupied areas surrounding the group, a person simply walked away from his dwelling area a short distance and relieved himself.

As civilizations developed, the concentrations of people increased rapidly. In such societies, disposal of human waste became a problem. As a result, joint disposal facilities were necessary. Early sewage disposal systems were simply open ditches that ran through the communities.

The awareness that sewage was a breeding place for disease organisms caused concern about health hazards so efforts were made to design sewage disposal systems which minimized contact and exposure of people to the sewage. Plumbing systems were developed that utilized flush toilets and enclosed piping for sewage removal.

More recently, changes in sanitary devices such as toilets and the like have involved primarily appearance rather than functional changes. The only change in use that has gained even a reasonable degree of acceptance is the soft toilet seat. It is questionable whether this can be considered a functional design change.

While the basic design of sanitary devices has not changed through the years, it does not follow that there are no deficiencies in their design or problems with their use. One serious shortcoming of toilets is the splashing that occurs when the toilet is used as a urinal. Since the urine travels a considerable distance before striking the surface of the pool of water in the toilet bowl, the force exerted on the water surface causes splashing.

Although toilet bowls are designed to provide a significant distance from the water line to the rim in an attempt to reduce droplets splashing out of the bowl, there still may be considerable splashing onto adjacent surfaces. Walls, flooring and the clothes of the person using the commode may be spotted.

With a person's attention being directed predominately toward making sure that the urine stream enters the toilet bowl rather than outside the bowl, the user may not even be aware that any droplets have splashed outside the bowl. Realization may not be made until much later when someone is cleaning the toilet and is in close proximity to the device. Extra time then has to be spent in cleaning the surrounding walls, flooring and the like.

The person doing the cleaning may advise others in the household of the problem, but there is little anyone can do to prevent repetition of the situation. Thus, a family has no alternative but to accept the situation as it exists. This is particularly difficult to accept by a housekeeper who is conscientious about the cleanliness of her home.

The problem is compounded if any surfaces are absorbent such as carpeting. Such materials are more difficult to clean and the possibility of odors developing is much greater.

When droplets have splashed onto clothing, either time must be taken to change clothes or to attempt to remove the spots or else they simply are allowed to dry and forgotten. If the spots are not discovered before the person has returned to a public place, and it is observed by another person, considerable embarassment may result.

From the above discussion, it is clear that present and past sanitary devices do not provide a solution to the problem of splashing in many situations. Thus, there is a need for a new liquid circulation system for sanitary devices that overcomes this deficiency.

The present invention provides a novel liquid circulation system for sanitary devices with features and advantages not found in earlier products. The liquid circulation system of the present invention significantly reduces splashing of droplets from the pool of water in the device. This substantially reduces the frequency of cleaning areas surrounding the toilet or similar devices. Also, it avoids the frustration and possible embarassment from splashing onto clothes.

The liquid circulation system of the present invention is simple in design and can be fabricated relatively inexpensively. Commercially available materials and components can be employed in its manufacture. The components of the system are durable in construction and have a long useful life. Little, if any, maintenance is required to keep the system in good operating condition.

The components of the liquid circulation system of the invention can be installed by persons with limited mechanical or plumbing experience easily and in a short period of time. The system can be modified to function with a wide variety of designs and different sanitary devices including toilets, urinals and the like. The liquid circulation system can be added to sanitary devices now installed as well as new products currently being manufactured.

These and other benefits and advantages of the novel liquid circulation system of the present invention will be apparent from the following description and the accompanying drawings in which.

Figure 1:
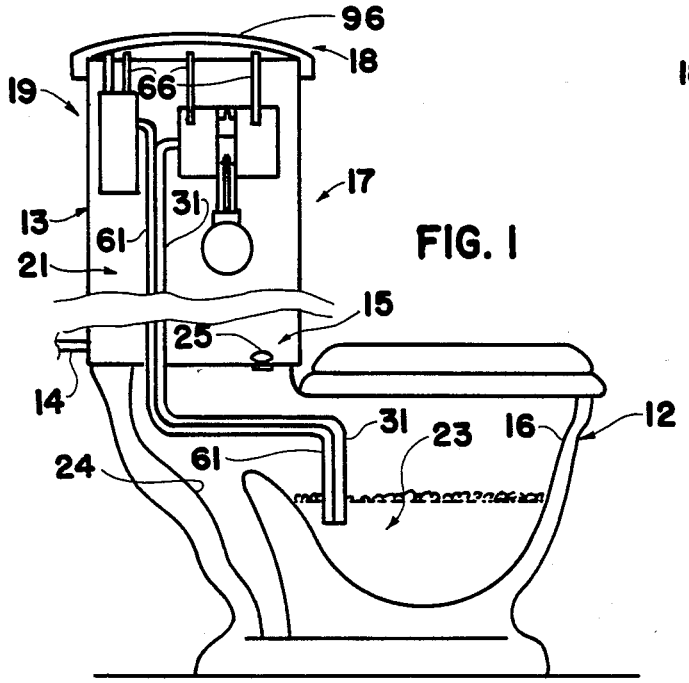
FIG. 1 is a side view in section of one form of the sanitary device liquid circulation system of the invention shown in use with a toilet.

As shown in the drawings, one form of the liquid circulation system 11 of the present invention is in use with a sanitary device such as a toilet 12. The toilet 12 includes a water supply tank 13, a water inlet line 14, a delivery section 15 and a bowl 16. The liquid circulation system 11 of the invention includes a water supply portion 17, an additive supply portion 18 and an air supply portion 19.

The water supply portion 17 of the circulation system 11 includes a water source 21 shown as water in supply tank 13 of FIG. 1. The system 11 also includes a water pool 23 that is selectively renewable. In the case of the toilet 12, the pool 23 is the water that is retained in the bowl 16 after flushing.

A delivery passage 24 extends from the water source 21 to the water pool 23. Valve means 25 is included in the water supply portion. Valve 25 controls the flow of water from the water source to the water pool 23. As shown, the valve 25 is the toilet valve that opens when the toilet is flushed to release the water in tank 13 through delivery passage 24 into the bowl 16.

The additive supply portion 18 of the liquid circulation system 11 of the invention includes an additive reservoir 30. A first conduit 31 extends from the reservoir 30 to the delivery passage 24. Metering means 32 is disposed along the first conduit 31. The metering means 32 includes a chamber 33 and a movable piston 34 disposed within the chamber.

Figure 2:
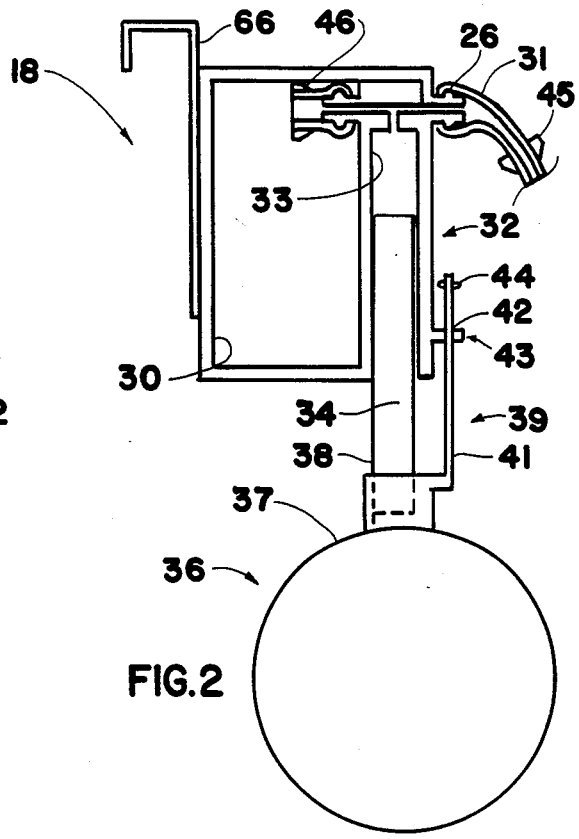
FIG. 2 is an enlarged right end view in section of the additive supply portion of the liquid circulation system shown in FIG. 1.
Figure 3:
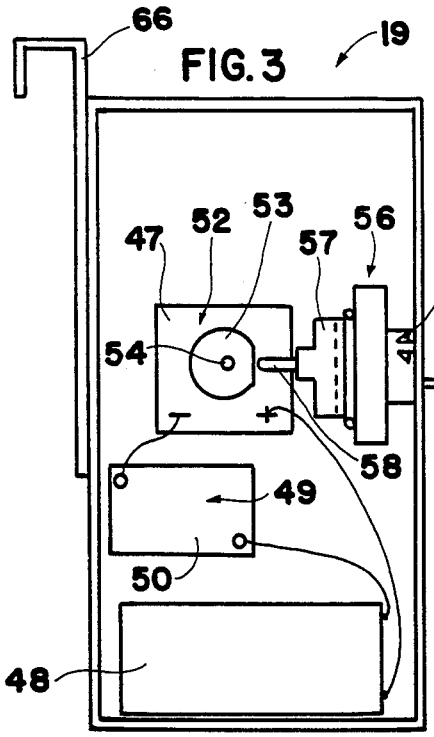
FIG. 3 is an enlarged right end view in section of the air supply portion of the liquid circulation system shown in FIG. 1.
Figure 5:
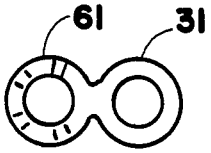
FIG. 5 is an enlarged cross-sectional view of conduits of the liquid circulation system of the invention.
Figure 6:
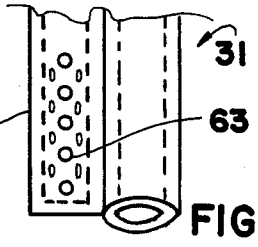
FIG. 6 is an enlarged fragmentary side view of the air supply portion of the liquid circulation system of the invention.

The piston 34 is movable in response to water flow changes in the water supply portion. The piston 34 advantageously includes a float member 36 operatively connected thereto. As shown in FIGS. 1 and 2, the float member is a hollow ball 37 affixed to the free end 38 of the piston 34.

The metering means 32 preferably includes adjustable quantity controlling means 39 shown as the combination of a float rod 41 that extends through an opening 42 in bracket 43. An O-ring 44 is adjustably positioned on the float rod as a stop to limit the movement of the piston 34.

The first conduit 31 advantageously includes one-way valves 45 and 46. These valves are positioned before and after the metering means 32 in terms of the flow of additive therethrough. The additive reservoir 30 preferably is formed integrally with the metering chamber 33.

The air supply portion 19 of the circulation system 11 of the present invention includes an electrical motor 47 and an electrical power source shown as battery 48 for a direct current motor. Control means 49 intermittently actuates the motor 47. The control 49 advantageously is a time delay relay 50.

The air supply portion 19 also includes pulsing means 52. The pulsing means is operatively connected to the motor 47. The pulsing means preferably is a cam member 53 that is disposed on an output shaft 54 of the motor.

Pump means 56 is included in the air supply portion 19. The pump means 56 includes a movable diaphragm 57 that is responsive to the pulsing means 52. This may be accomplished through a finger member 58 that extends from the center of the diaphragm that periodically contacts cam 53 as it is rotated by motor 47.

The pump means 56 also includes an outlet 59. A second conduit 61 extends from the outlet 59 of the pump into the water pool 23 of the water supply portion 17. The second conduit 61 includes an outlet section 62 that is disposed below the surface of the water pool. The outlet provides a multiplicity of small spaced openings 63. The pump 56 advantageously includes inlet and outlet one-way valves 64 and 65 respectively.

The additive supply portion 17 and the air supply portion 19 advantageously include hanger means 66 for positioning of the units inside a toilet tank 13. To facilitate installation, it is desirable that the first and second conduits 31 and 61 respectively be disposed in an adjacent parallel relationship along a substantial part of their lengths.

Figure 4:
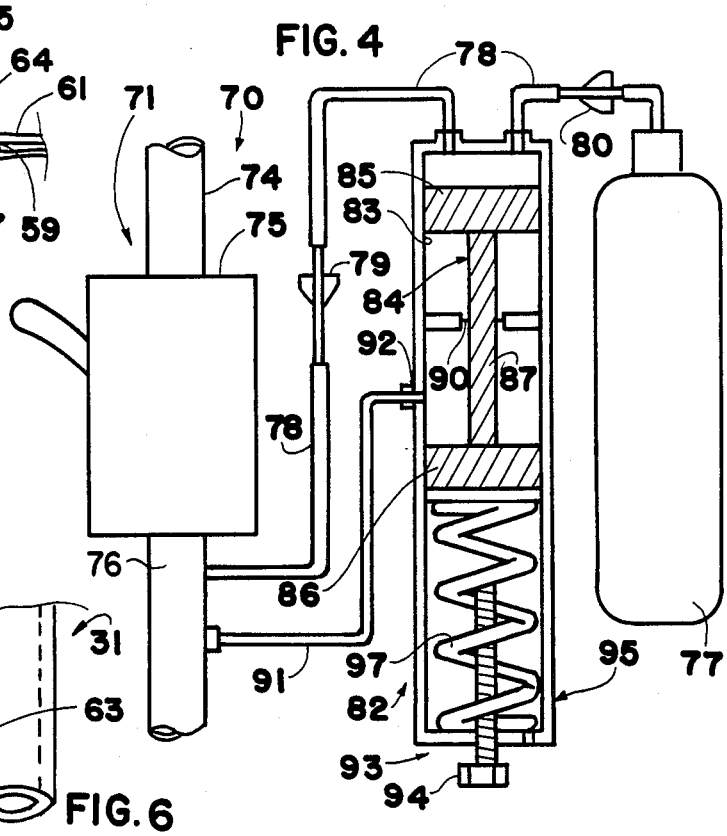
FIG. 4 is a fragmentary side view partially in section of another form of liquid circulation system of the invention.

FIG. 4 illustrates part of another form of the liquid circulation system of the present invention. The illustration shows a liquid circulation system 70 that is suitable for use with a tank-less sanitary device such as a tank-less toilet of the type used in commercial applications or a urinal or a similar device (none of which are shown).

The system 70 includes a water supply portion 71, an additive supply portion 72 and an air supply portion (not shown). The water supply portion 71 includes a water inlet line 74 with a valve 75. A delivery passage 76 extends to a water pool of the sanitary device (not shown).

The additive supply portion 72 of the liquid circulation system 70 includes an additive reservoir 77. A first conduit 78 extends from the reservoir to the delivery passage 76. Metering means is disposed along the first conduit. The first conduit 78 advantageously includes one-way valves 79 and 80 on either side of the metering means.

The metering means 82 includes a chamber 83 and a movable piston 84 that is disposed within the chamber. The piston is movable in response to water flow changes in the delivery passage of the water supply portion 71. The piston 84 includes two spaced piston sections 85 and 86. The piston sections are joined by a connecting rod section 87.

The chamber 83 includes sealing means 90 surrounding the connecting rod section 87. A conduit 91 extends from the delivery passage 76 to the chamber at a point 92 between the piston sections 85 and 86 and below the seal 90, that is, between the section 86 and the seal.

The metering means also preferably includes adjustable quantity controlling means 93 shown as a threaded screw 94 that extends into the chamber from an end thereof remote from the first conduit. Changing the position of the screw with respect to the chamber limits the movement of the piston 84.

The air supply portion of the system 70 may be the same as that of the circulation system 11 described above with a motor, a power source, a motor control, pulsing means and a pump, with an air conduit.

Since the water supply portion 71 does exclude a water supply tank, the liquid circulation system 70 may include a housing 95 securable to the water inlet line 74 adjacent the valve 75. The additive and air supply portions may be housed within the housing 95.

The components of the liquid circulation system of the present invention may be fabricated from a variety of materials including metals, plastics and the like, with plastics being preferred. Advantageously as shown in FIG. 2, several components can be formed together as a unitary structure.

In the use of the liquid circulation system, the components first are installed with the sanitary device. With system 11, the lid 96 of the water supply tank 13 is lifted off and the combined first and second conduits 31 and 61 run between the tank and the bowl. This can be accomplished by threading the conduits through the delivery passage 24 to the bowl 16. Alternatively, the conduits can extend along the outside of the tank and over the rim of the bowl into the water pool therein.

The additive and air supply portions 18 and 19 may be suspended in the tank 13 with hangers 66. The free end 35 of the first conduit 31 is attached to the outlet 26 of the metering means. Similarly, the free end 67 of the second conduit 61 is attached to the outlet 59 of the pump 56.

The additive reservoir 30 is filled with a surfactant such as an organic acid salt, e.g. a linear alkyl benzene sulfonate, an ether sulfate or another known surface-active agent or a mixture of such materials. Also, a battery 48 is connected to the motor 47. The system now is ready for use.

The liquid circulation system functions automatically. Each time the toilet is flushed, the tank 13 empties. As the water level in the tank drops, float member 36 moves downwardly with the water level. This causes the piston 34 attached thereto to be drawn downward in the chamber 33. As the piston is drawn downward, surfactant from reservoir 30 is drawn through the first conduit into the upper part of the chamber above the piston. The distance that the piston travels and thus the amount of surfactant is controlled by the position of the O-ring 44 on the rod 41.

After the flushing has been completed, the tank 13 fills with water again. As the water level rises into contact with the float member 36 and continues to rise, piston 34 is forced upward in the chamber 33. This expells the measured quantity of the surfactant in the upper part of the chamber to flow from the chamber along the second section of the first conduit and out the discharge end thereof below the surface of the water pool 23 in the bowl 16.

The operation of the air supply pump 56 is controlled by relay 50 which provides a sequence of intermittent operating periods. The relay activates motor 47 which causes cam 53 to periodically move pump diaphragm 57 to send a quantity of air along second conduit 61 and through the multiplicity of very small spaced openings 63 in outlet section 62 thereof. This discharge of the air produces a large number of minute bubbles which facilitates the formation of a foam on the surface of the water pool.

The relay actuates the motor 47 periodically whether or not the toilet is flushed. Thus, the foam is constantly maintained so it will be present when the toilet is used again. After use, the toilet is flushed again and the sequence of steps is repeated with surfactant being discharged into the new water pool and the air being periodically bubbled into the water to create and maintain the foam.

When the toilet is used, urine striking the foam surface is absorbed into the water pool rather than being deflected by the surface and splashed out of the bowl and onto surrounding areas such as walls, flooring and clothes of the user.

The circulation system 70 shown in FIG. 4 is installed with a sanitary device by attaching the additive and air supply portions to the water inlet line 74 or another convenient location and connecting conduits 78 and 91 to the delivery passage 76. After filling the additive reservoir 77 with surfactant and attaching a battery to the air supply portion, the system is ready for use.

In the use of the system 70, the sanitary device (not shown) is used in the conventional way with valve 75 being opened after use to initiate the flushing. When valve 75 is opened, water passes through the valve and then through passage 76. Some of the water in the passage 76 moves through conduit 91 and into chamber 83 between piston section 86 and seal 90.

The pressure of the water in the chamber causes piston section 86 to move downwardly against biasing means, e.g. spring 97. This action causes piston 85 also to move downward drawing surfactant from reservoir 77 into the chamber space above the piston 85. When the flushing is complete and valve 75 is closed, water no longer passes through delivery 76.

Since spring 97 is urging piston sections 85 and 86 upwardly, the additive in the upper part of the chamber will be forced through first conduit 78 including one-way valves 79 and 80 along the second section thereof and into the delivery passage 76 from which it will be conveyed to the sanitary device.

The air supply portion (not shown) functions independently of the flushing of the sanitary device in the same way as described for air supply portion 19 above. A foam is created on the surface of the water pool and continuously maintained. The operation of the circulation system 70 is repeated each time the valve is opened with new surfactant being injected into the delivery passage 76 and therefrom into the water pool.

In this way, splashing of urine is minimized since the urine is absorbed into the foam rather than being splashed out of the bowl. Thus, contamination of surrounding walls, floors and clothes is substantially eliminated.

It has been found that one cubic centimeter of an aqueous surfactant solution with less than about 25% active ingredients provides a constant foam in the toilet bowl with approximately two gallon capacity when an air pump having a capacity of about one liter per minute is operated for about five minutes every fifteen minutes.

The above description and the accompanying drawings show that the present invention provides a novel liquid circulation system for a sanitary device with features and advantages not found in earlier products. The circulation system of the invention significantly reduces splashing of droplets from the water pool in the device. This substantially eliminates contamination of surrounding areas such as walls, flooring, carpeting and particularly clothes of the user. Thus, odors, intensive cleaning and embarrassment are avoided. Also, the additives keep the toilet bowl especially clean.

The liquid circulation system of the invention is simple in design and can be fabricated relatively inexpensively. Commercially available materials and components can be utilized in its manufacture. The system components are durable in construction and require little maintenance.

The circulation system can be installed conveniently in a short period of time even by persons with limited mechanical or plumbing aptitude and experience. The system can be adapted to a wide variety of different sanitary devices easily. The circulation system can be added to sanitary devices now in use as well as being incorporated in the design of sanitary devices at the factory.

It will be apparent that various modifications can be made in the particular liquid circulation system described in detail above and shown in the drawings within the scope of the present invention. The size, configuration and arrangement of components can be changed to meet specific requirements. Also, positioning and attachment of components with respect to the sanitary device can be different for particular sanitary device designs. These and other changes can be made in the circulation system described provided the functioning and operation thereof are not adversely affected. Therefore, the scope of the present invention is to be limited only by the following claims.

What is claimed is:

1. A sanitary device liquid circulation system including a water supply portion, an additive supply portion and an air supply portion; said water supply portion including a water source, a selectively renewable water pool, a delivery passage extending from said water source to said water pool, valve means controlling the flow of water from said water source to said water pool; said additive supply portion including an additive reservoir, a first conduit extending from said reservoir to said delivery passage, metering means disposed along said first conduit, said metering means including a chamber, a movable piston disposed within said chamber, said piston being movable in response to water flow changes in said water supply portion; said air supply portion including an electrical motor, an electrical power source for said motor, timing sequence control means intermittently actuating said motor periodically, pulsing means operatively connected to said motor, pump means including a movable diaphragm responsive to said pulsing means during periods that said motor is operating, an outlet from said pump means, a second conduit extending from said outlet into said water pool, said second conduit including an outlet in said water pool providing a multiplicity of small spaced openings; whereby a predetermined quantity of additive is metered into said pool of water in response to water flow changes in said water supply portion and air periodically is introduced intermittently into said water pool in a multiplicity of bubbles to form and maintain a foam on the surface of said water pool.

2. A sanitary device liquid circulation system according to claim 1 wherein said water supply portion includes a toilet.

3. A sanitary device liquid circulation system according to claim 1 wherein said water supply portion includes a toilet with a water supply tank.

4. A sanitary device liquid circulation system according to claim 1 wherein said metering means includes adjustable quantity controlling means.

5. A sanitary device liquid circulation system according to claim 1 wherein said first conduit includes one-way valves before and after said metering means.

6. A sanitary device liquid circulation system according to claim 1 wherein said piston of said metering means includes a float member operatively connected thereto.

7. A sanitary device liquid circulation system according to claim 1 wherein said additive supply portion and said air supply portion include hanger means for positioning thereof inside a toilet tank.

8. A sanitary device liquid circulation system according to claim 1 wherein said additive reservoir is formed integrally with said metering chamber.

9. A sanitary device liquid circulation system according to claim 1 wherein said first and second conduits are disposed in an adjacent parallel relationship along a substantial part of their lengths.

10. A sanitary device liquid circulation system according to claim 1 wherein said piston includes two spaced piston sections joined by a connecting rod section.

11. A sanitary device liquid circulation system according to claim 10 wherein said chamber includes sealing means surrounding said connecting rod section.

12. A sanitary device liquid circulation system according to claim 10 wherein said additive supply portion includes a third conduit extending from said delivery passage to said chamber at a point between said piston sections.

13. A sanitary device liquid circulation system according to claim 1 wherein said motor of said air supply portion is a direct current motor and said power source thereof is a battery.

14. A sanitary device liquid circulation system according to claim 1 wherein said pulsing means includes a cam member disposed on an output shaft of said motor.

15. A sanitary device liquid circulation system according to claim 1 wherein said motor control means includes a time delay relay.

16. A sanitary device liquid circulation system according to claim 1 wherein said air pump means includes inlet and outlet one-way valves.

* * * * *